US010287691B2

(12) United States Patent
Al-Kandari

(10) Patent No.: US 10,287,691 B2
(45) Date of Patent: May 14, 2019

(54) ANODE ASSEMBLY FOR CATHODIC PROTECTION OF OFFSHORE STEEL PILES

(71) Applicant: EQUATE PETROCHEMICAL CO., Safat (KW)

(72) Inventor: Nabeel Y. A. A. Al-Kandari, Safat (KW)

(73) Assignee: EQUATE Petrochemicals Co., Safat (KW)

( * ) Notice: Subject to any disclaimer, the term of this patent is extended or adjusted under 35 U.S.C. 154(b) by 0 days.

(21) Appl. No.: 15/433,996

(22) Filed: Feb. 15, 2017

(65) Prior Publication Data

US 2018/0230604 A1 Aug. 16, 2018

(51) Int. Cl.

| | |
|---|---|
| ***C23F 13/00*** | (2006.01) |
| ***C23F 13/18*** | (2006.01) |
| ***E02B 17/00*** | (2006.01) |

(52) U.S. Cl.
CPC ..... *C23F 13/18* (2013.01); *E02B 17/0026* (2013.01); *C23F 2213/31* (2013.01)

(58) Field of Classification Search
CPC ..... C23F 13/02; C23F 13/06; C23F 13/08; C23F 13/10; C23F 13/18; C23F 13/20; C23F 2201/00; C23F 2201/02; C23F 2213/30; C23F 2213/313; E02B 17/0026
See application file for complete search history.

(56) References Cited

U.S. PATENT DOCUMENTS

| | | | | |
|---|---|---|---|---|
| 2,870,079 A | | 1/1959 | McCall | |
| 4,035,903 A | * | 7/1977 | Taggart | C23F 13/02 204/196.15 |
| 4,133,737 A | * | 1/1979 | Trimble | C23F 13/02 204/196.19 |
| 4,170,532 A | * | 10/1979 | Tatum | E21B 41/02 204/196.3 |
| 4,171,254 A | * | 10/1979 | Koenecke | C23F 13/02 204/196.1 |
| 4,292,149 A | * | 9/1981 | Warne | C23F 13/16 204/196.2 |
| 4,442,903 A | * | 4/1984 | Schutt | C23F 13/02 166/385 |

(Continued)

OTHER PUBLICATIONS

Ashworth (Principles of Cathodic Protection, vol. 2, pp. 10:3-10:28).*

*Primary Examiner* — Alexander W Keeling
(74) *Attorney, Agent, or Firm* — Richard C. Litman

(57) ABSTRACT

The anode assembly for cathodic protection of offshore steel piles provides stability and protection for a sacrificial anode used in the cathodic protection of offshore steel piles, particularly in regard to the challenges presented in positioning the anode in a submerged, underwater environment. The anode assembly for cathodic protection of offshore steel piles includes a conventional sacrificial anode received within a protective housing. The housing is supported underwater by a support cable. A weight is fixed to the lower end of the support cable to anchor the lower end of the support cable on an underwater surface of a body of water when the housing and the sacrificial anode are suspended in the body of water. The upper end of the support cable is secured to an external support such that the housing and the sacrificial anode are suspended therefrom in a desired underwater position.

2 Claims, 3 Drawing Sheets

(56) References Cited

U.S. PATENT DOCUMENTS

| | | | | |
|---|---|---|---|---|
| 4,710,644 | A | 12/1987 | Baach | |
| 4,740,106 | A * | 4/1988 | Bianchi | C23F 13/18<br>204/196.34 |
| 6,461,082 | B1 | 10/2002 | Smith | |
| 2009/0205951 | A1* | 8/2009 | Funahashi | C23F 13/02<br>204/196.37 |
| 2012/0188696 | A1* | 7/2012 | Gildseth | B63B 21/22<br>361/679.01 |
| 2014/0021063 | A1 | 1/2014 | Sergi et al. | |
| 2015/0299868 | A1 | 10/2015 | Sergi et al. | |

* cited by examiner

ANODE ASSEMBLY FOR CATHODIC PROTECTION OF OFFSHORE STEEL PILES

BACKGROUND OF THE INVENTION

1. Field of the Invention

The present invention relates to cathodic protection, and particularly to an anode assembly for the cathodic protection of offshore steel piles and the like which provides stability and protection for the anode in a submerged, underwater environment.

2. Description of the Related Art

Cathodic protection (CP) is a technique used to control the corrosion of a metal surface by making it the cathode of an electrochemical cell. A simple method of protection connects the metal to be protected to a more easily corroded "sacrificial metal" to act as the anode. Cathodic protection systems protect a wide range of metallic structures in various environments. Common applications include steel water or fuel pipelines, steel pier piles, offshore steel piles, ship and boat hulls, offshore oil platforms and onshore oil well casings, offshore wind farm foundations and metal reinforcement bars in concrete buildings and structures.

FIG. 2 illustrates a typical cathodic protection arrangement used for protecting submerged steel structures, such as offshore steel piles and the like. In FIG. 2, the steel structure 120 to be protected is partially submerged in seawater W. An external support 122 is positioned above the water (i.e., in a dry, above-water environment) and sacrificial anode 112 is suspended therefrom by insulated anode cable 114. A direct current (DC) power source 116 is electrically connected on its positive side to the anode via insulated anode cable 114, and the negative side of DC power source 116 is in electrical contact with the steel structure 120 via negative return cable 118. The iron in the steel is the primary cause of corrosion in the partially submerged portion of the steel structure 120. The corrosion of the iron begins with a breakdown of the iron into iron ions and free electrons: $2Fe \rightarrow 2Fe^{++} + 4e^{-}$. The free electrons travel through the established conductive path to less active sites, where oxygen gas is converted to oxygen ions (through combination with the four free electrons), which combines with water to form hydroxyl ions: $O_2 + 4e^{-} + 2H_2O \rightarrow 4OH^{-}$. Recombination of these ions at the active surface yield the iron-corrosion product ferrous hydroxide through iron combining with oxygen and water to form the ferrous hydroxide: $2Fe + O_2 + 2H_2O \rightarrow 2Fe(OH)_2$.

Aluminum is a common material used in the manufacture of sacrificial anodes, such as anode 112. Using aluminum as an example, cathodic protection begins with a reaction at the aluminum surface, resulting in four aluminum ions plus twelve free electrons: $4Al \rightarrow 4Al^{+++} + 12e^{-}$. At the steel surface, oxygen gas is converted to oxygen ions which combine with water to form hydroxyl ions: $3O_2 + 12e^{-} + 6H_2O \rightarrow 12OH^{-}$. As long as the current (i.e., the free electrons) arrives at the cathode (i.e., the steel structure 120) faster than oxygen is arriving, no corrosion will occur.

In the particular CP application illustrated in FIG. 2, cathodic protection of offshore steel piles presents a unique challenge for implementing CP. Specifically, the particular submerged, underwater environment makes it difficult to maintain proper positioning of the anode. The anodes used with such offshore steel piles often become entangled in fishing nets, for example, as well as being susceptible to support cable failure due to strong currents created by passing boats, in addition to snagging by underwater materials. Thus, an anode assembly for cathodic protection of offshore steel piles solving the aforementioned problems is desired.

SUMMARY OF THE INVENTION

The anode assembly for cathodic protection of offshore steel piles provides stability and protection for a sacrificial anode used in the cathodic protection of offshore steel piles and like, particularly in regard to the challenges presented in positioning the anode in such a submerged, underwater environment. The anode assembly for cathodic protection of offshore steel piles includes a conventional sacrificial anode received within a protective housing. The housing has an open upper end and an open lower end. The open upper end is releasably covered and sealed by a cap, and the lower end remains open, allowing seawater to enter the housing for contacting the anode.

The housing is supported underwater by a support cable, which has opposed upper and lower ends. A weight is fixed to the lower end of the support cable to anchor the lower end of the support cable on an underwater surface of a body of water when the housing and the sacrificial anode are suspended in the body of water. The weight anchors the support cable at a desired distance away from the structure to be cathodically protected.

An external support member is supported above the body of water. The upper end of the support cable is secured to the external support such that the housing and the sacrificial anode are suspended therefrom, by the support cable, in the desired underwater position. A direct current (DC) electrical power source is provided, preferably safely distanced from the water's surface, and the sacrificial anode is in electrical contact with the positive terminal of the DC electrical power source through an anode cable. A negative return cable is further provided, such that the structure to be cathodically protected is in electrical contact with the negative terminal of the DC electrical power source through the negative return cable.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
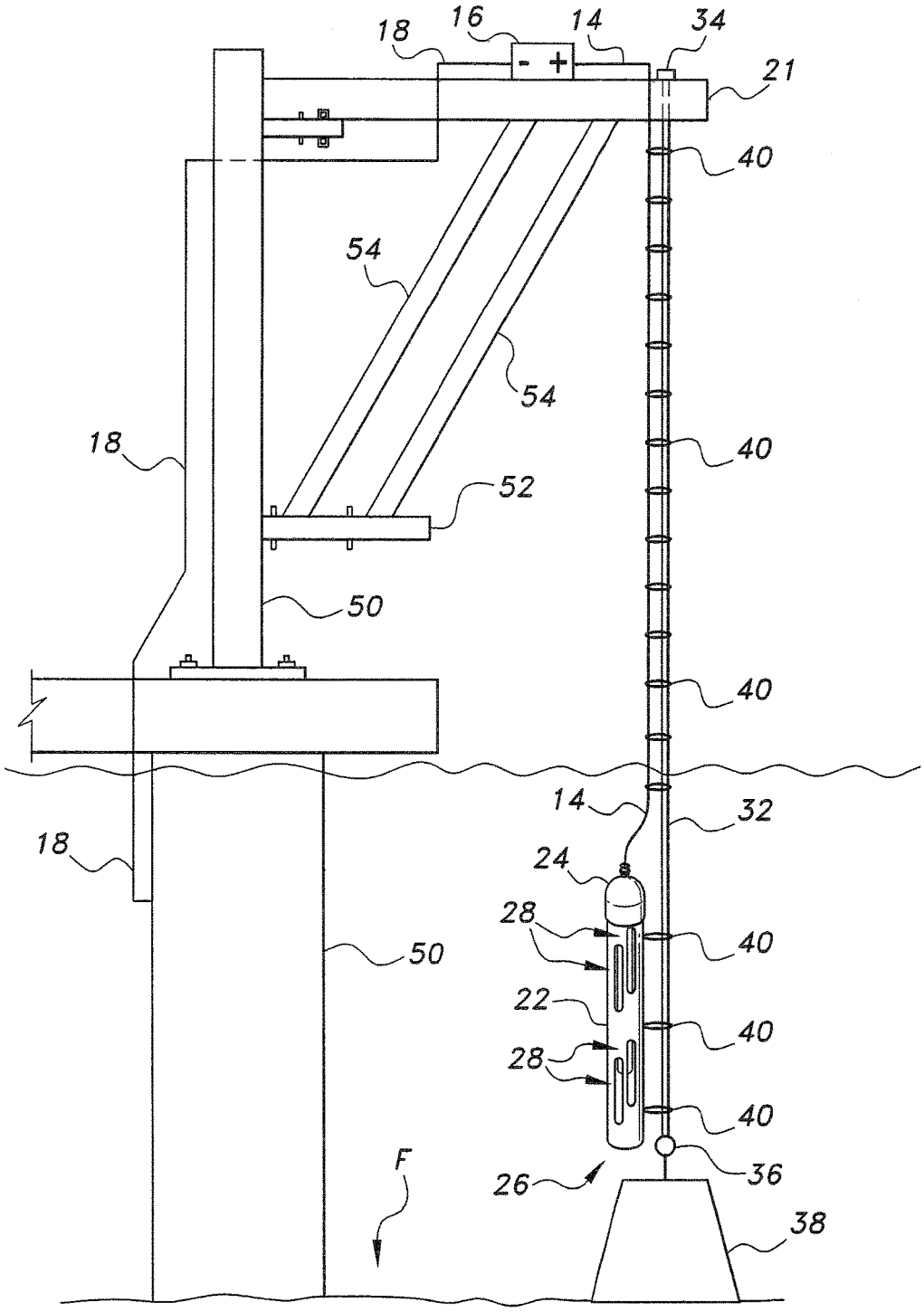
FIG. 1 diagrammatically illustrates an anode assembly for cathodic protection of offshore steel piles according to the present invention.
Figure 3:
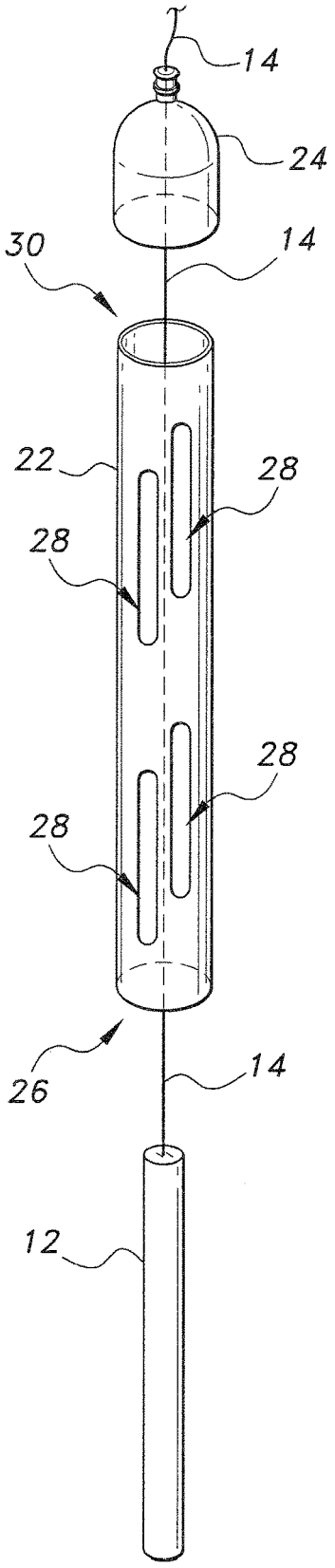
FIG. 3 is an exploded perspective view of a sacrificial anode and housing therefor of the anode assembly for cathodic protection of offshore steel piles.

The anode assembly for cathodic protection of offshore steel piles 10 provides stability and protection for a sacrificial anode 12 used in the cathodic protection of offshore steel piles and like, particularly in regard to the challenges presented in positioning the anode 12 in such a submerged, underwater environment. As shown in FIGS. 1 and 3, the anode assembly for cathodic protection of offshore steel piles 10 includes a conventional sacrificial anode 12 received within a protective housing 22. The sacrificial anode 12 is similar to an anode used in conventional cathodic protection systems, and may be manufactured from any suitable type of sacrificial metal, such as aluminum, Ag—AgCl or the like.

Figure 2:
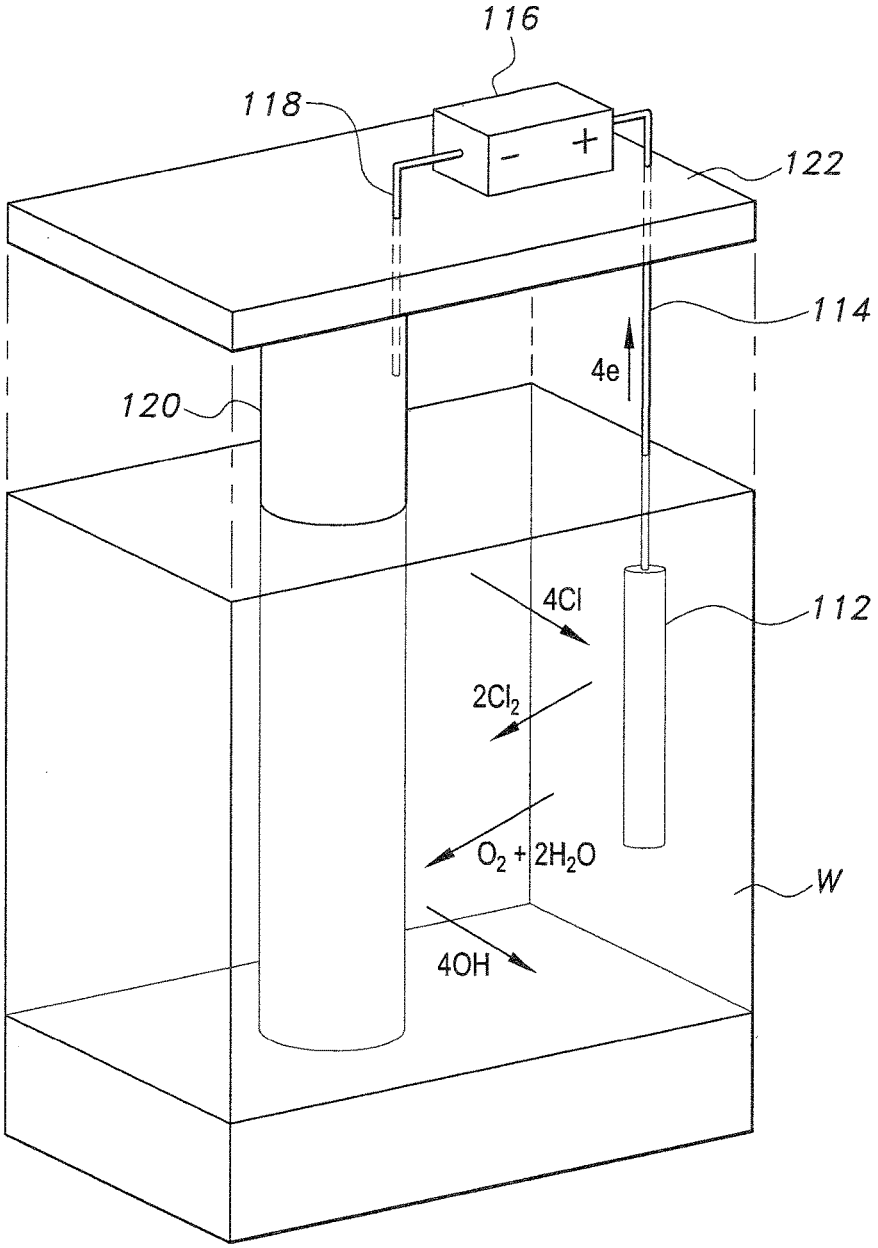
PRIOR ART FIG. 2
FIG. 2 diagrammatically illustrates a conventional prior art cathodic protection assembly.

The housing 22 has an open upper end 30 and an open lower end 26. The open upper end is releasably covered and sealed by a cap 24, and the lower end 26 remains open, allowing seawater W to enter the housing 22 for contacting the sacrificial anode 12. In FIGS. 1 and 2, the housing 22 is shown as having a substantially cylindrical contour and cap 24 is shown as having a corresponding contour for mating with the circular upper end 30. It should be understood that housing 22 and cap 24 may have any suitable contouring or relative dimensions, and are illustrated in FIGS. 1 and 3 for exemplary purposes only. Further, housing 22 may have a plurality of water passages 28 defined through at least one wall thereof, as shown, providing multiple passages for seawater W to enter housing 22 and contact the sacrificial anode 12.

The housing 22 is supported underwater by a support cable 32, which has opposed upper and lower ends 34, 36, respectively. Housing 22 and anode cable 14, which will be explained in detail below, are shown fixed to support cable 32 by rings or loops 40. It should be understood that housing 22 and anode cable 14 may be secured to support cable 32 by any suitable type of fixture, such as ties, brackets, rings, loops or the like. Support cable 32 may be formed from polypropylene or any other material suitable for maintaining support of housing 22 and sacrificial anode 12 in a seawater environment.

A weight 38 is fixed to the lower end 36 of the support cable 32 to anchor the lower end 36 of the support cable 32 on an underwater surface of a body of water W (shown in FIG. 1 as exemplary ocean floor F) when the housing 22 and the sacrificial anode 12 are suspended in the body of water W. The weight 38 anchors the support cable 32 at a desired distance away from the structure to be cathodically protected (indicated in FIG. 1 generally by the numeral 50). It should be understood that weight 38 is shown in FIG. 1 for exemplary purposes only and may have any suitable configuration for anchoring the support cable 32 in place with respect to floor F.

An external support member 21 is supported above the body of water W. The upper end 34 of the support cable 32 is secured to the external support member 21 such that the housing 22 and the sacrificial anode 12 are suspended therefrom, by the support cable 32, in the desired underwater position. In FIG. 1, an exemplary arrangement of additional angled supports 54, mounted on a platform 52 associated with exemplary steel pile 50, is shown. In this example, the angled supports 54 provide stability for the external support member 21. It should be understood that this is an exemplary arrangement only, and that any suitable type of mounting or support may be used to suspend the support cable 32, housing 22 and sacrificial anode 12 in the desired position with respect to steel pile 50. The external support member 21 and the associated construction elements, such as angled supports 54 and platform 52, are preferably formed from galvanized materials or the like, suitable for a potentially corrosive seawater environment.

As in a conventional cathodic protection system, a direct current (DC) electrical power source 16 is provided, preferably safely distanced from the water's surface, and the sacrificial anode 12 is in electrical contact with the positive terminal of the DC electrical power source 16 through an anode cable 14. A negative return cable 18 is further provided, such that the structure to be cathodically protected 50 is in electrical contact with the negative terminal of the DC electrical power source 16 through the negative return cable 18. Returning to FIG. 3, the anode cable 14 preferably passes through an opening formed through cap 24, as shown. The removable cap 24 provides easy access to the housing 22 for replacement of sacrificial anode 12.

It is to be understood that the present invention is not limited to the embodiments described above, but encompasses any and all embodiments within the scope of the following claims.

I claim:

1. An anode assembly for cathodic protection of offshore steel piles located in seawater, consisting of:

a single sacrificial anode;

a single anode cable attached to the single sacrificial anode;

a cylindrical housing consisting of an open upper end, an open lower end, and a wall enclosing and defining the housing, the single sacrificial anode and a portion of the single anode cable being received within the housing, the housing having a plurality of elongated water passages disposed through the housing wall and being located circumferentially about the housing whereby seawater can enter the housing and contact the single sacrificial anode;

a cap for releasably covering and sealing the open upper end of the housing, wherein an opening is formed through the cap and the portion of the single anode cable passes through the opening;

a single support cable having opposed upper and lower ends;

means for supporting the cylindrical housing and the non-housed portion of the anode cable to the single support cable;

a weight fixed to the lower end of the single support cable, whereby the weight is adapted for anchoring the lower end of the single support cable on an underwater surface of a body of seawater when the housing and the single sacrificial anode are suspended in the body of seawater;

an external support member supported above the body of seawater, the upper end of the single support cable being secured to the external support member;

a direct current electrical power source, the single sacrificial anode being in electrical contact with a positive terminal of the direct current electrical power source through the single anode cable; and a negative return cable, whereby a structure to be cathodically protected is in electrical contact with a negative terminal of the direct current electrical power source through the negative return cable.

2. The anode assembly for cathodic protection of offshore steel piles as recited in claim 1, wherein the single support cable comprises a polypropylene cable.

* * * * *